US006701740B1

(12) United States Patent
Hernandez-Zelaya

(10) Patent No.: US 6,701,740 B1
(45) Date of Patent: Mar. 9, 2004

(54) AIR CONDITIONER WATER PAN DRAIN LINE AND CLEAN-OUT SYSTEM

(76) Inventor: Rodolfo Hernandez-Zelaya, 4217 E. 98 Ave., Tampa, FL (US) 33617-4432

( * ) Notice: Subject to any disclaimer, the term of this patent is extended or adjusted under 35 U.S.C. 154(b) by 0 days.

(21) Appl. No.: 10/224,829

(22) Filed: Aug. 21, 2002

(51) Int. Cl.[7] ..... F25D 21/14
(52) U.S. Cl. ..... 62/291; 62/303; 137/625.47
(58) Field of Search ..... 62/291, 289, 288, 62/303; 137/625.47, 240, 268, 385

(56) References Cited

U.S. PATENT DOCUMENTS

| | | | | | |
|---|---|---|---|---|---|
| 400,838 | A | * | 4/1889 | Stahel | 310/178 |
| 3,994,516 | A | * | 11/1976 | Fredd | 285/39 |
| 4,632,268 | A | * | 12/1986 | Melzi et al. | 220/573 |
| 4,709,831 | A | * | 12/1987 | Coplan | 220/304 |
| 4,962,778 | A | * | 10/1990 | Driskill | 134/169 C |
| 5,361,931 | A | * | 11/1994 | VanLandingham | 220/571 |
| 5,722,458 | A | * | 3/1998 | Potter | 137/625.47 |
| 5,996,603 | A | * | 12/1999 | Dupler | 137/1 |
| 6,068,023 | A | * | 5/2000 | Potter | 137/625.47 |
| 6,182,677 | B1 | * | 2/2001 | Pignataro | 137/15.05 |

FOREIGN PATENT DOCUMENTS

| | | | | |
|---|---|---|---|---|
| JP | 2002333155 | * | 11/2002 | F24F/1/00 |

* cited by examiner

*Primary Examiner*—William E. Tapolcai
*Assistant Examiner*—Mohammad M. Ali
(74) *Attorney, Agent, or Firm*—Edward P. Dutkiewicz

(57) ABSTRACT

An air conditioner water pan drain line and clean-out system has a clean-out body with an upper end. A lower end of the body has an end piece forming an internal recess with the body having an opening at the upper end with a female thread and two protruding round, tubular, horizontal hollow cylindrical passageways. A top cap in a disk-like configuration has a male thread sized to be received by and firmly held by the female thread of the body. A horizontally disposed connecting pipe has a first end coupled over with and securely held onto one of the protruding round, tubular hollow cylindrical passageways and a second end with male threads.

1 Claim, 2 Drawing Sheets

FIG 3
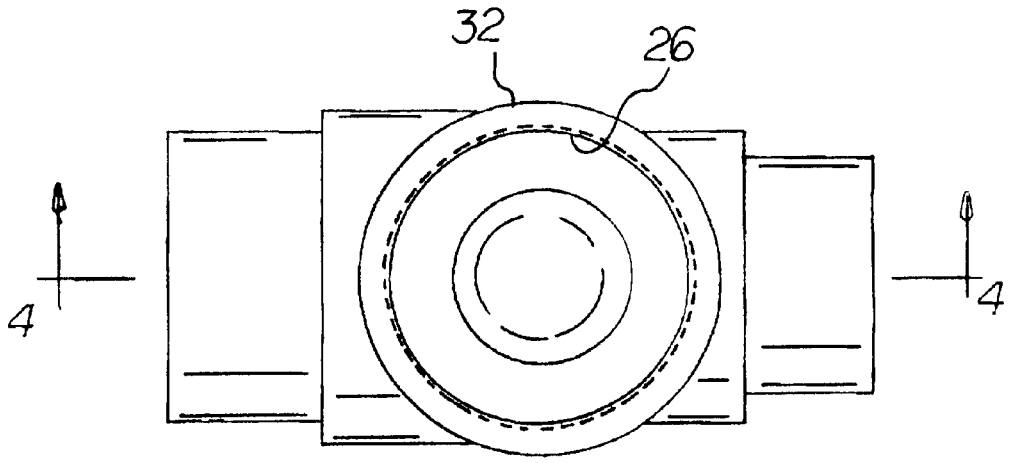
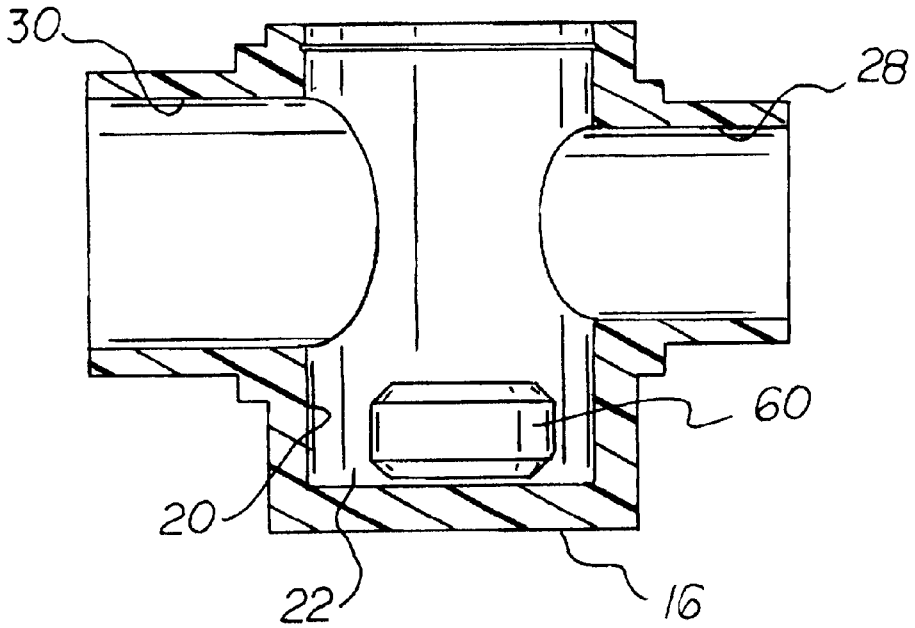
FIG 4

AIR CONDITIONER WATER PAN DRAIN LINE AND CLEAN-OUT SYSTEM

BACKGROUND OF THE INVENTION

1. Field of the Invention

The present invention relates to an air conditioner water pan drain line and clean-out system and more particularly pertains to allowing a user to safely and conveniently gain access to an internal pipe passageway for cleaning and maintenance of the passageway.

2. Description of the Prior Art

The use of water lines for draining and cleaning out containers of known designs and configurations is known in the prior art. More specifically, water lines for draining and cleaning out containers of known designs and configurations previously devised and utilized for the purpose of cleaning and maintaining containers and pipes by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,182,677 issued Feb. 6, 2001, to Pignataro discloses a cleanout fitting for air conditioner evaporator drains. U.S. Pat. No. 6,068,023 issued May 30, 2000, to Potter discloses a valve for clearing air conditioning drain lines. U.S. Pat. No. 5,722,458 issued Mar. 3, 1998 to Potter discloses a valve for clearing air conditioning drain lines. Lastly, U.S. Pat. No. 4,962,778 issued Oct. 16, 1990, to Driskill discloses a backwashing dispenser for air conditioner drain pans.

While these devices fulfill their respective, particular objectives and requirements, the aforementioned patents do not describe an air conditioner water pan drain line and clean-out system that allows allowing a user to safely and conveniently gain access to an internal pipe passageway for cleaning and maintenance of the passageway.

In this respect, the air conditioner water pan drain line and clean-out system according to the present invention substantially departs from the conventional concepts and designs of the prior art, and in doing so provides an apparatus primarily developed for the purpose of allowing a user to safely and conveniently gain access to an internal pipe passageway for cleaning and maintenance of the passageway.

Therefore, it can be appreciated that there exists a continuing need for a new and improved air conditioner water pan drain line and clean-out system which can be used for allowing a user to safely and conveniently gain access to an internal pipe passageway for cleaning and maintenance of the passageway. In this regard, the present invention substantially fulfills this need.

SUMMARY OF THE INVENTION

In view of the foregoing disadvantages inherent in the known types of water lines for draining and cleaning out containers of known designs and configurations now present in the prior art, the present invention provides an improved air conditioner water pan drain line and clean-out system. As such, the general purpose of the present invention, which will be described subsequently in greater detail, is to provide a new and improved air conditioner water pan drain line and clean-out system and method which has all the advantages of the prior art and none of the disadvantages.

To attain this, the present invention essentially comprises a clean-out body fabricated of rigid material. The clean-out body is in a round tubular hollow cylindrical configuration. The clean-out body has an upper end and a lower end and a circumferential side wall there between. The lower end has an end piece continuous with the side wall and closing off the lower end thereby forming an internal recess within the body. The body has an opening at the upper-end with a female thread within the internal diameter of the body. The body also has two protruding round, tubular, horizontal, hollow cylindrical passageways in axial alignment into and out of the body to allow the ingress and egress of fluid to and from the clean-out body. Next provided is a top cap fabricated of rigid material. The top cap has a generally round, disk-like configuration with an upper side and a lower side and a circumferential edge there between. The upper side is flat. The lower side has a male thread sized to be received by and firmly held by the female thread of the body. In this manner the cap closes off and seals the body. A horizontally disposed connecting pipe fabricated of rigid material is next provided. The connecting pipe has a first end sized to be press fit and coupled over with and securely held onto one of the protruding round, tubular hollow cylindrical passageways. A second end of the connecting pipe has male threads. Next provided is a fluid container. The fluid container is positionable beneath an air conditioner and functions to collect water generated by an air conditioner. The container has a vertical side wall. A threaded aperture in the container is sized to be securely coupled with the male threads of the connecting pipe thereby forming a continuous passageway for fluid from the container to pass through the body of the clean-out. A chlorine tablet is positioned in the internal recess. The chlorine tablet is in a cylindrical configuration and has a diameter less than the inside diameter of the top cap.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air conditioner water pan drain line and clean-out system which has all of the advantages of the prior art water lines for draining and cleaning out containers of known designs and configurations and none of the disadvantages.

It is another object of the present invention to provide a new and improved air conditioner water pan drain line and clean-out system which may be easily and efficiently manufactured and marketed.

It is further an object of the present invention to provide a new and improved air conditioner water pan drain line and clean-out system which is of durable and reliable constructions.

An even further object of the present invention is to provide a new and improved air conditioner water pan drain line and clean-out system which is susceptible of a low cost of manufacture with regard to both materials and labor, and which accordingly is then susceptible of low prices of sale to the consuming public, thereby making such air conditioner water pan drain line and clean-out system economically available to the buying public.

Even still another object of the present invention is to provide an air conditioner water pan drain line and clean-out system for allowing a user to safely and conveniently gain access to an internal pipe passageway for cleaning and maintenance of the passageway.

Lastly, it is an object of the present invention to provide a new and improved n air conditioner water pan drain line and clean-out system having a clean-out body with an upper end and a lower end of the body having an end piece forming an internal recess with the body having an opening at the upper end with a female thread and two protruding round, tubular, horizontal hollow cylindrical passageways. A top cap in a disk-like configuration has a male thread sized to be received by and firmly held by the female thread of the body. A horizontally disposed connecting pipe has a first end coupled over with and securely held onto one of the protruding round, tubular hollow cylindrical passageways and a second end with male threads.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a plan view taken along line 3—3 of FIG. 2.

FIG. 4 is a cross sectional view taken along line 4—4 of FIG. 3.

The same reference numerals refer to the same parts throughout the various Figures.

DESCRIPTION OF THE PREFERRED EMBODIMENT

Figure 1:
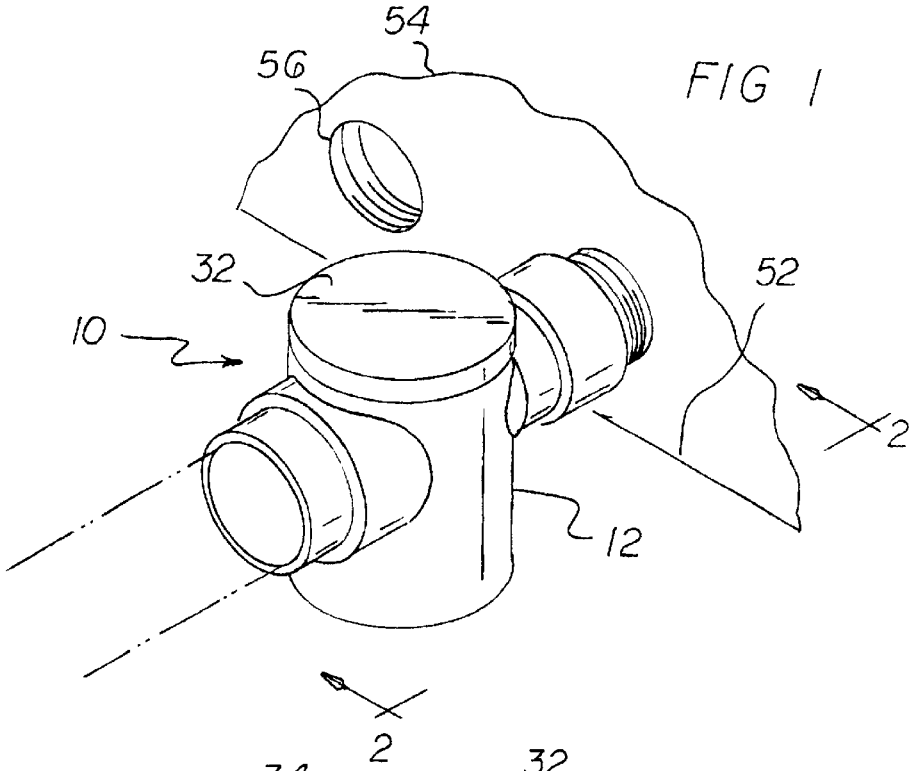
FIG. 1 is a perspective illustration of an air conditioner water pan drain line and clean-out system constructed in accordance with the principles of the present invention.
Figure 2:
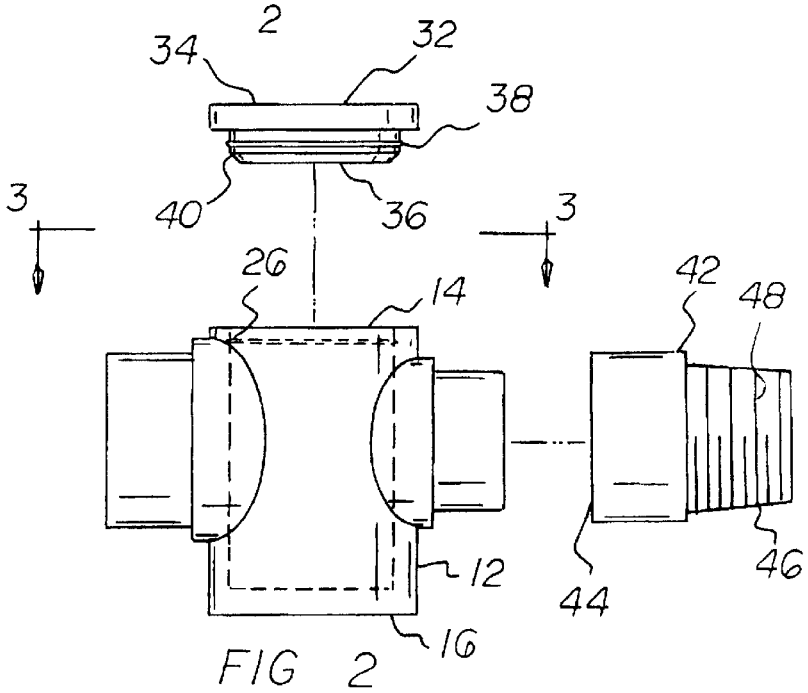
FIG. 2 is an exploded side elevational view taken along line 2—2 of FIG. 1.

With reference now to the drawings, and in particular to FIG. 1 thereof, the preferred embodiment of the new and improved air conditioner water pan drain line and clean-out system embodying the principles and concepts of the present invention and generally designated by the reference numeral 10 will be described.

The present invention, the air conditioner water pan drain line and clean-out system 10 is comprised of a plurality of components. Such components in their broadest context include a clean-out body, a top cap, and a connecting pipe. Such components are individually configured and correlated with respect to each other so as to attain the desired objective.

First provided is a clean-out body 12 fabricated of rigid material. The clean-out body is in a round tubular hollow cylindrical configuration. The clean-out body has an upper end 14 and a lower end 16 and a circumferential side wall 18 there between. The lower end has an end piece 20 continuous with the side wall and closing off the lower end thereby forming an internal recess 22 within the body. The body has an opening 24 at the upper end with an internal female thread 26 within the body. The body also has two protruding round, tubular, horizontal, hollow cylindrical passageways 28, 30 in axial alignment into and out of the body to allow the ingress and egress of fluid to and from the clean-out body.

Next provided is a top cap 32 fabricated of rigid material. The top cap has a generally round, disk-like configuration with an upper side 34 and a lower side 36 and a circumferential edge 38 there between. The upper side is flat. The lower side has a male thread 40 sized to be received by and firmly held by the female thread of the body. In this manner the cap closes off and seals the body.

A horizontally disposed connecting pipe 42 fabricated of rigid material is next provided. The connecting pipe has a first end 44 sized to be press fit and coupled over with and securely held onto one of the protruding round, tubular hollow cylindrical passageways. A second end 46 of the connecting pipe has male threads 48.

Next provided is a fluid container 52. The fluid container is positionable beneath an air conditioner and functions to collect water generated by an air conditioner. The container has a vertical side wall 54. A threaded aperture 56 in the side wall of container is sized to be securely coupled with the male threads of the connecting pipe thereby forming a continuous passageway for fluid from the container to pass through the body of the clean-out.

A chlorine tablet 60 is positioned in the internal recess. The chlorine tablet is in a cylindrical configuration and has a diameter less than the inside diameter of the top cap.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to on e skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioner water pan drain line and clean-out system for allowing a user to safely and conveniently gain access to an internal pipe passageway for cleaning and maintenance of the passageway comprising, in combination:

a clean-out body fabricated of rigid material and having a round tubular hollow cylindrical configuration with an upper end and a lower end and a circumferential side wall there between with the lower end having an end piece continuous with the side wall and closing off the lower end thereby forming an internal recess within the body, with the body having an opening at the upper end with an internal female thread, with the body also having two protruding round, tubular, horizontal, hollow cylindrical passageways in axial alignment into and out of the body to allow the ingress and egress of fluid into and out of the body of the clean-out body;

a top cap fabricated of rigid material and having a generally round, disk-like configuration with an upper side and a lower side and a circumferential edge there between with the upper side being flat and the lower side having a male thread sized to be received by and firmly held by the female thread of the body to allow the closing off and sealing of the body with the cap;

a connecting pipe horizontally disposed and fabricated of rigid material with a first end sized to be press fit and coupled over with and securely held onto one of the protruding round, tubular hollow cylindrical passageways and with a second end with male threads;

a fluid container positionable beneath an air conditioner for collecting water generated by an air conditioner, the container having a vertical side wall and having a threaded aperture sized to be securely coupled with the male threads of the connecting pipe and thereby forming a continuous passageway for fluid from the container to pass through the body of the clean-out; and a tablet positioned in the internal recess with a cylindrical configuration having a diameter less than the top cap.

* * * * *